US007021299B2

(12) United States Patent
Torrisi et al.

(10) Patent No.: US 7,021,299 B2
(45) Date of Patent: Apr. 4, 2006

(54) MULTICHANNEL ELECTRONIC IGNITION DEVICE WITH HIGH-VOLTAGE CONTROLLER

(75) Inventors: Giovanni L. Torrisi, Catania (IT); Antonino Torres, Catania (IT); Nicola A. Liporace, Belvedere Marittimo (IT)

(73) Assignee: STMicroelectronics S.r.l., (IT)

( * ) Notice: Subject to any disclaimer, the term of this patent is extended or adjusted under 35 U.S.C. 154(b) by 0 days.

(21) Appl. No.: 10/814,819

(22) Filed: Mar. 31, 2004

(65) Prior Publication Data

US 2004/0255920 A1 Dec. 23, 2004

(30) Foreign Application Priority Data

Apr. 1, 2003 (EP) ..... 03425202

(51) Int. Cl.
*F02P 5/15* (2006.01)

(52) U.S. Cl. ..... 123/618; 123/620; 123/640; 123/644

(58) Field of Classification Search ..... 123/605, 123/609, 618, 620, 640, 641, 644, 651, 652; 315/209.1

See application file for complete search history.

(56) References Cited

U.S. PATENT DOCUMENTS 4,441,479 A * 4/1984 Endo et al. ..... 123/620
4,913,123 A * 4/1990 DeBiasi et al. ..... 123/644
5,113,839 A 5/1992 Hartmann et al.
5,623,912 A 4/1997 Kelly
6,142,130 A 11/2000 Ward
6,213,108 B1 4/2001 Boyer et al.

FOREIGN PATENT DOCUMENTS

EP 0 390 314 10/1990
EP 0 661 449 7/1995
EP 0 711 917 5/1996

OTHER PUBLICATIONS

Yedinak, et al., "Operation of an IGBT in a Self-Clamped Inductive Switching Circuit (SCIS) for Automotive Ignition", Proceedings of the 10th International Syumposium on Power Semiconductor Devices & IC's (ISPSD), Kyoto, Jun. 3, 1998, pp. 399-402, XP000801102.
European Search Report, EP 03 425202, dated Aug. 27, 2003.

* cited by examiner

*Primary Examiner*—Willis R. Wolfe, Jr.
(74) *Attorney, Agent, or Firm*—Jenkens & Gilchrist, PC

(57) ABSTRACT

A control circuit is connected to a plurality of driving stages. Each driving stage includes a high-voltage terminal for driving an inductive load. The control circuit is provided with a corresponding plurality of control stages. These control stages are integrated in a single semiconductor body and connected each to the high-voltage terminal of a respective driving stage.

23 Claims, 4 Drawing Sheets

MULTICHANNEL ELECTRONIC IGNITION DEVICE WITH HIGH-VOLTAGE CONTROLLER

PRIORITY CLAIM

The present application claims priority from European Patent Application No. 03425202.3 filed Apr. 1, 2003, the disclosure of which is hereby incorporated by reference.

BACKGROUND OF THE INVENTION

1. Technical Field of the Invention

The present invention relates to a multichannel electronic-ignition control device with high-voltage controller.

2. Description of Related Art

As is known, electronic-ignition devices are used for generating sparks between two electrodes and thus sparking off combustion of a gas or of a mixture of air and a fuel set in the proximity of the electrodes. A very common example of application of electronic-ignition devices, to which reference will be made hereinafter (without this, however, being considered in any way limiting) regards the field of controlled-ignition internal-combustion engines. In this case, the sparks produced are used for sparking off combustion of the air-fuel mixture inside each of the cylinders of the engine.

Normally, electronic-ignition devices comprise a control circuit and a power switch, such as for example an insulated-gate bipolar transistor (IGBT). As is known, the power switch is controlled so as to open and close, alternately, the connection between a supply source (battery) and the primary winding of a transformer, which has a secondary winding connected to a spark plug, where the electrodes for generation of sparks are located. In particular, in a first stage, the power switch closes the circuit, and a current that increases in time in a substantially linear way starts flowing in the primary winding. Next, the power switch is re-opened, interrupting sharply the current flow in the primary winding and causing a voltage peak, which is transferred to the secondary winding. Thanks to the advantageous ratio between the number of turns of the primary winding and the number of turns of the secondary winding (for example 1:100), the amplitude of the voltage peak on the secondary winding is markedly increased and is sufficient for generating an electric arc between the electrodes of the spark plug.

In order to reduce the overall dimensions and the costs of fabrication of electronic-ignition devices, solutions have been proposed that envisage the use of a single multichannel control device, controlling a plurality of power switches. In particular, the control device must supply control voltages normally of about 10–15 V to the power switches and hence may be made in a first semiconductor wafer using standard techniques for the fabrication of semiconductors. The power switches, instead, have to withstand voltages of 250–600 V and hence have to be made in separate semiconductor wafers, using special technologies for preventing the risk of breakdown.

Multichannel electronic-ignition devices of the type described, however, suffer from a number of serious limitations. In fact, the control circuit cannot interact with the high-voltage terminals of the power switches, because it is unable to withstand the voltage peaks necessary for generation of the sparks. Consequently, it is not possible to intervene in order to attenuate the undesired effects which are normally associated to power components. In certain operating conditions, in particular, the high-voltage terminals of power switches may oscillate and need to be stabilized. Otherwise, in fact, the oscillations may have an amplitude sufficient for producing undesirable sparks, thereby causing serious problems. In addition, it may be necessary to drive the power switches so as to cause gradual and controlled discharge of the energy stored in the windings of the transformer if any malfunctioning is identified. Also the immediate opening of the circuit by the power switches could in fact produce undesirable sparks.

There is a need in the art to provide an electronic-ignition control device which is free from the drawbacks described above.

SUMMARY OF THE INVENTION

In accordance with one embodiment of the present invention, a multichannel electronic-ignition control device includes a plurality of driving stages, one for each channel, and each having a high-voltage terminal to drive an inductive load. A control circuit is connected to each of the driving stages. The control circuit includes a corresponding plurality of control stages that are integrated in a single semiconductor body, with each being connected to the high-voltage terminal of a respective one of the driving stages.

In accordance with another embodiment of the present invention, an apparatus for electronic ignition comprises a battery supplying a supply voltage and a plurality of transformers, each having primary and secondary windings connected to the battery. An ignition-control circuit is also connected to the battery and has a plurality of driving stages, one for each transformer. Each driving stage has an output coupled to the primary winding of the corresponding transformer. The ignition control circuit further includes a corresponding plurality of control stages, one for each driving stage, which are integrated on a single semiconductor body.

In accordance with another embodiment of the present invention, a multichannel inductive load control device comprises a plurality of driving stages, one for each of a plurality of inductive load channels, and each having a high-voltage terminal to drive its associated inductive load. A control circuit includes a plurality of control stages, one for each driving stage, with each control stage including a control terminal and an actuation terminal, the actuation terminal connected to cause actuation of the associated driving stage to drive the inductive load. The control circuit further includes a sensor circuit connected to each inductive load and operable to detect successful driving of any one of the inductive loads and output a detection signal indicative thereof. A logic circuit is connected to the control terminals of the control stages to individually control actuation of the associated driving stage and receive the detection signal from the sensor circuit in response to detected successful driving of the inductive loads.

In yet another embodiment of the invention, an inductive load control device comprises a high voltage power transistor including a first conduction terminal to drive an inductive load, the power transistor further including a control terminal. A control stage has a control input to receive an activation signal and an output connected to the control terminal of the power transistor to control selective driving of the inductive load. A sensor circuit is connected to the first conduction terminal of the high voltage power transistor and operates to detect successful driving of the inductive load.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

For greater clarity of exposition, in the ensuing description reference will be made to the use of the invention in the sector of controlled-ignition internal-combustion engines. As already mentioned previously, this is not to, be considered in any way limiting, since the invention may be advantageously exploited also in other fields.

Figure 1:
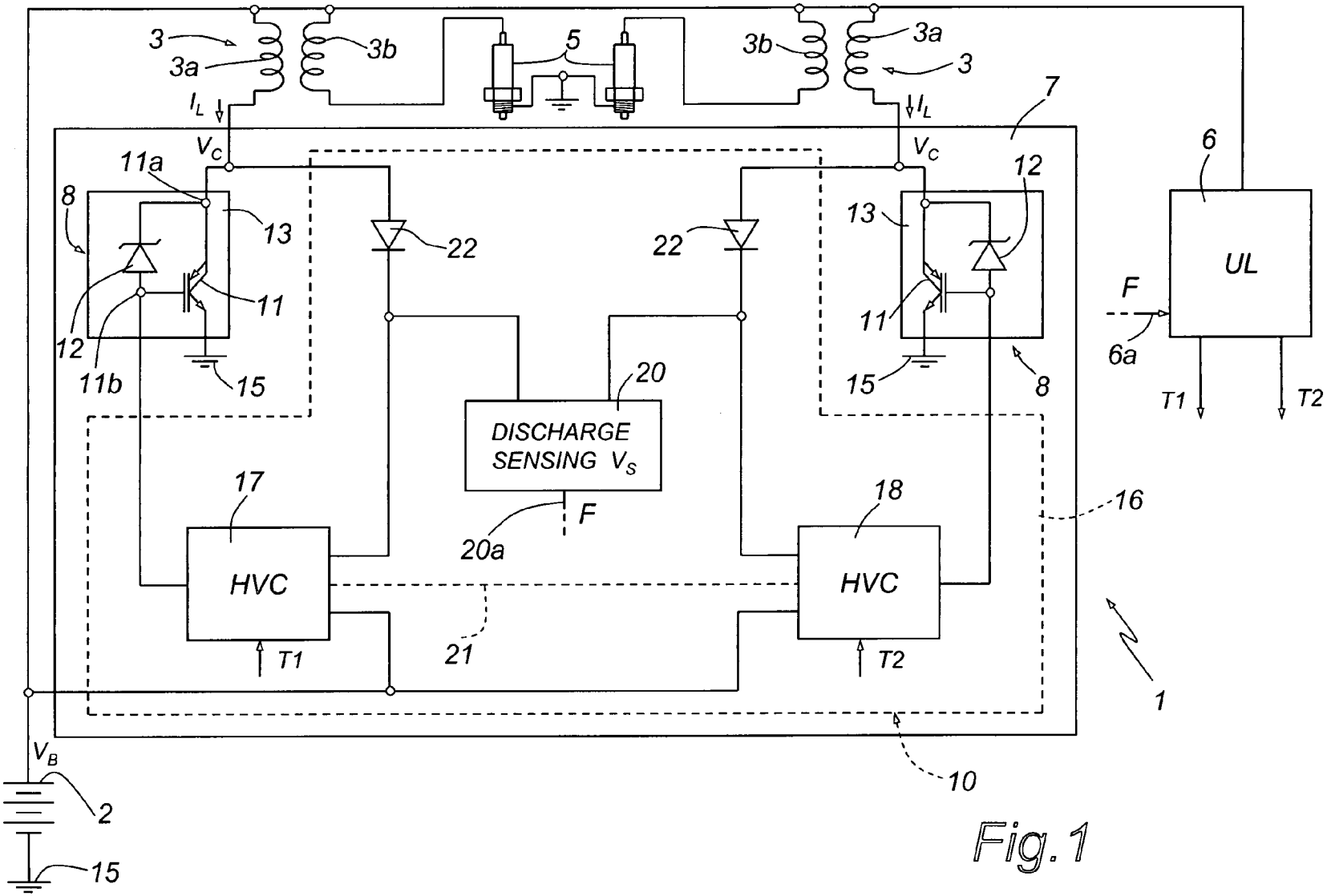
FIG. 1 illustrates a simplified circuit diagram of an electronic-ignition apparatus incorporating a multichannel electronic-ignition control device built according to the present invention.

FIG. 1 illustrates an electronic-ignition apparatus 1 comprising a battery 2, supplying a supply voltage $V_B$ of, for example, 12 V, a plurality of transformers 3, connected to respective spark plugs 5, a logic control unit 6 and a multichannel ignition control device 7.

The transformers (two in the non-limiting example described) are equipped with respective primary windings 3*a* and secondary windings 3*b* with a ratio of transformation of, for example, 1:100. In particular, the primary windings 3*a* are connected to the battery 2 and to respective terminals of the ignition control device 7, while the secondary windings 3*b* are connected to the battery 2 and to respective spark plugs 5.

The logic unit 6, which preferably comprises a microprocessor, has an input connected to the battery 2 and supplies the ignition control device 7 with activation signals T1, T2 for energizing the transformers 3 and the spark plugs 5 independently.

The ignition control device 7 comprises power driving stages 8, each connected to the primary winding 3*a* of a respective transformer 3 and a high-voltage control circuit 10. Hereinafter, the terms "high-voltage" and "power" will be used to indicate electrical components and/or circuits capable of withstanding voltages of the order of at least hundreds of volts (typically, 200–600 V).

The driving stages 8 are made on separate respective semiconductor chips 13 and comprise respective power transistors 11, which in the embodiment illustrated are vertical-current-flow IGBTs, and limiting diodes 12. In greater detail, each of the power transistors 11 has collector terminal 11*a* connected to the primary winding 3*a* of the respective transformer 3 and emitter terminal connected to a ground line 15, which is set at a reference potential and is here illustrated schematically by the ground symbol. Moreover, on the collector terminals 11*a* of the power transistors 11 there are collector voltages $V_C$. The limiting diodes 12 have cathode and anode terminals connected to the gate and collector terminals 11*b*, 11*a*, respectively, of the power transistors 11, and have a predetermined reverse breakdown voltage, comprised between 250 V and 600 V, and preferably of 400 V.

The high-voltage control circuit 10 is made on a further distinct semiconductor chip 16 and comprises a first control stage 17, a second control stage 18, each connected to a respective driving stage 8, and a discharge-sensing stage 20 (voltage flag). In detail, the first and the second control stages 17, 18 have respective first sensing inputs, connected to the battery 2, and second sensing inputs, connected to the collector terminals 11*a* of the power transistors 11 of the respective driving stages 8; the control stages 17, 18 are hence high-voltage stages. In addition, the first and the second control stages 17 are connected to the logic unit 6 for receiving, respectively, the first activation signal T1 and the second activation signal T2. The outputs of the control stages 17, 18 are instead connected to the gate terminals 11*b* of the respective power transistors 11.

The control stages 17, 18 are directly connected together through the substrate 21 of the chip 16, which in FIG. 1 is illustrated schematically by means of a dashed line. In fact, the high-voltage control circuit 10, which is connected to the collector terminals 11*a* of the power transistors 11, in turn comprises vertical-current-flow electronic power components, as clarified hereinafter. On the other hand, vertical-current-flow power components normally use the substrate as conduction terminal (collector or drain terminal, according to the type of component); consequently, the substrate 21 is common to all of the power components 16 integrated on the chip. In order to prevent, during the spark-generation step, high voltages from propagating through the substrate 21 between the primary windings 3*a* of the transformers 3, decoupling diodes 22 are used, each having an anode connected to the collector terminal 11*a* of a respective power transistor 11 and a cathode connected to the second sensing input of a respective one between the first and the second control stages 17, 18. In this way, the primary windings 3*a* are connected to the common substrate 21 in just a one-directional way: consequently, the voltages generated on the primary windings 3*a* of the transformers 3 during discharge may be propagated to the corresponding control stages 17, 18, whereas the propagation of voltages between the primary windings 3*a* is blocked. The primary windings 3*a* may therefore be energized separately and independently.

The discharge-sensing circuit 20 has inputs connected to respective collector terminals 11*a* of the power transistors 11 and hence also to respective primary windings 3*a* of the transformers 3. An output 20*a* of the discharge-sensing circuit 20 is connected to an input 6*a* of the logic unit 6 and supplies a recognition pulse F whenever a spark is generated between the electrodes of one of the spark plugs 5.

In practice, the logic unit 6, through the activation signals T1, T2, activates alternately in sequence the control stages 17, 18 of the high-voltage control circuit 10. When they are activated, the control stages 17, 18 switch on the respective power transistors 11, and a winding current $I_L$ starts to flow alternately in the primary windings 3*a* of one of the transformers 3, and increases substantially linearly in time. As mentioned previously, the primary windings 3*a* of the transformers 3 are decoupled by means of the decoupling diodes 22 and hence may be energized separately and independently. The power transistor 11 each time activated is switched off at a predetermined instant, interrupting sharply the passage of current in the corresponding primary winding 3*a*. The collector voltage $V_C$ has therefore a peak, which is limited to the reverse breakdown voltage of the corresponding limiting diode 12 (400 V); on the corresponding secondary winding 3*b* there is a voltage, which is higher, according to the ratio of transformation of the transformer 3, and is sufficient for triggering a spark between the electrodes of the spark plug 5 connected to the energized transformer 3.

When the collector voltage $V_C$ on the collector terminal of one of the power transistors 11 exceeds a predetermined threshold voltage $V_S$, the sensing circuit 20 supplies a recognition pulse F to the logic unit 6. In the event of malfunctioning, instead, the collector voltage $V_C$ does not exceed the threshold voltage $V_S$: in practice, the absence of a recognition pulse F at a predetermined instant indicates that a spark failed to be generated between the electrodes of a corresponding spark plug 5.

The integration in a single semiconductor chip of a number of high power control stages 17, 18 advantageously allows using just one sensing circuit 20 for monitoring the generation of the sparks on all of the spark plugs 5. On the one hand, thus, there is a reduction in the overall dimensions; on the other hand, the recognition pulses F corresponding to all of the spark plugs 5 are supplied in sequence on the same line, and hence just one pin of the logic unit 6 is to be occupied, instead of one pin for each spark plug 5. This is particularly important, because the constraints in the design of the logic unit 6 are significantly reduced.

Figure 2:
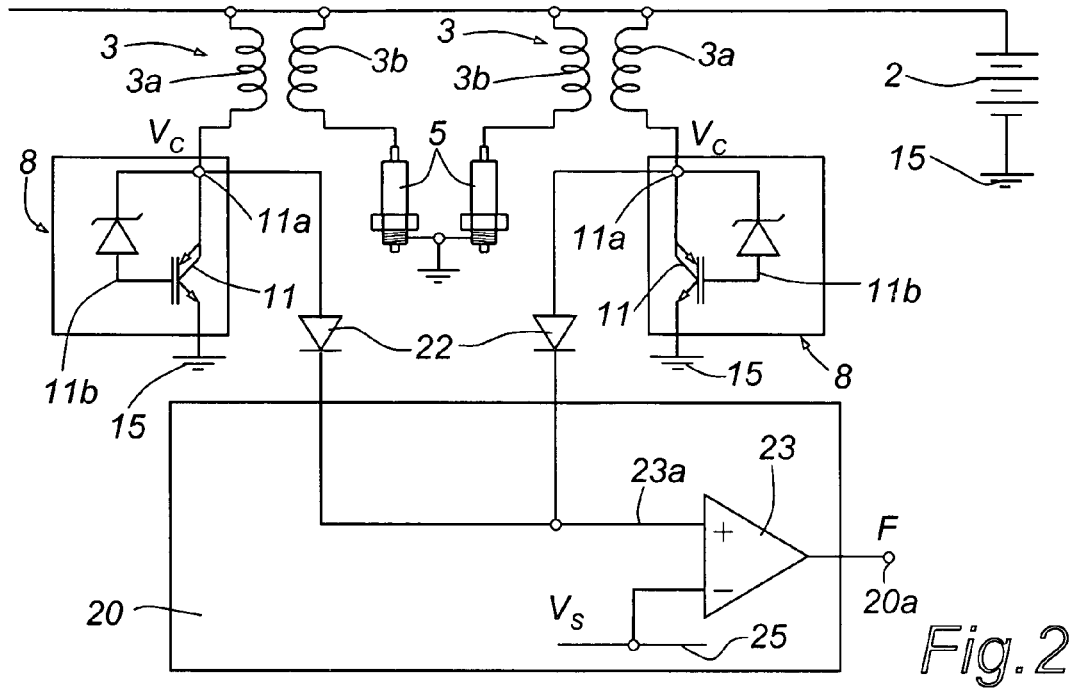
FIG. 2 is a detailed circuit diagram corresponding to parts of the apparatus illustrated in FIG. 1.

With reference to FIG. 2, where the apparatus 1 is illustrated only in part, the sensing circuit 20 comprises a comparator 23, which has an inverting terminal connected to a reference line 25 set at the threshold voltage $V_S$. The non-inverting terminal 23*a* of the comparator 23 is connected to the collector terminals 11*a* of the power transistors 11 through the respective decoupling diodes 22; more precisely, the non-inverting terminal 23*a* of the comparator 23 is connected to the cathodes of the decoupling diodes 22. The output of the comparator 23 forms the output 20*a* of the sensing circuit 20 and supplies the recognition pulses F when the collector voltage $V_C$ of one of the power transistors 11 exceeds the threshold voltage $V_S$.

Figure 3:
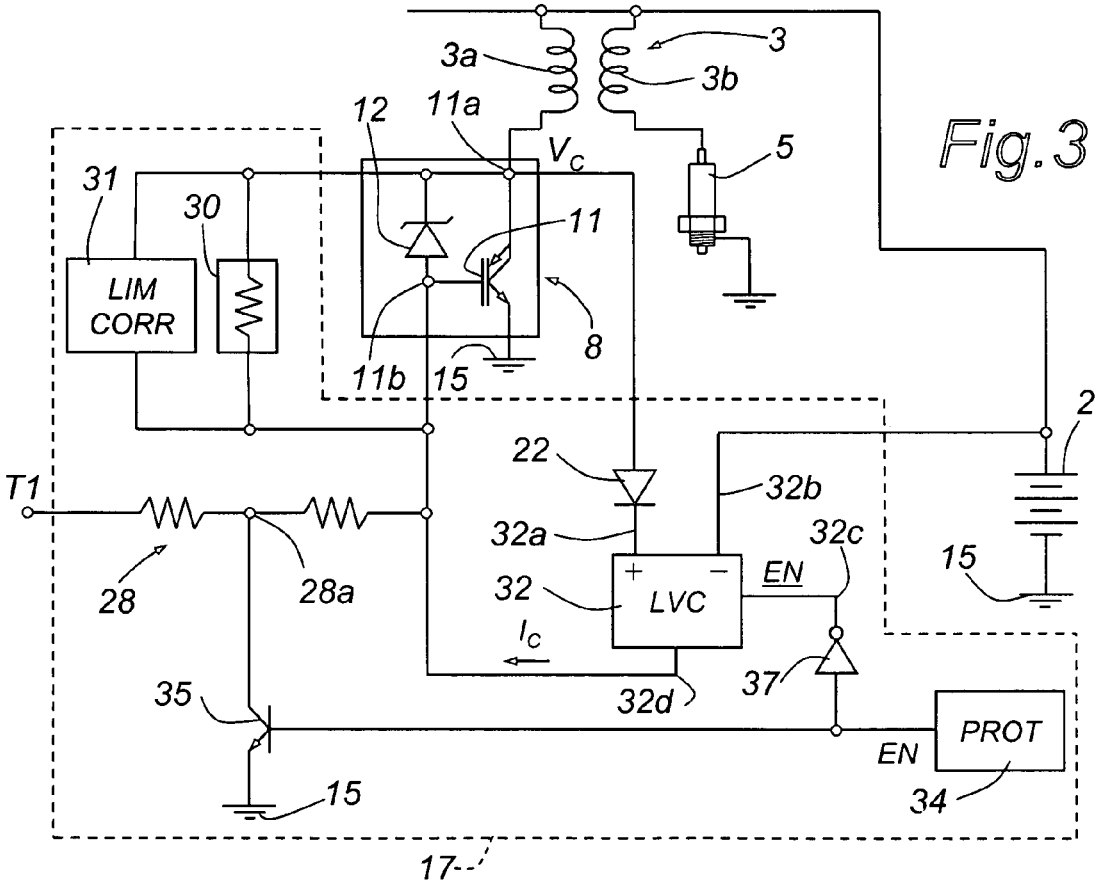
FIG. 3 is a detailed circuit diagram corresponding to parts of the apparatus illustrated in FIG. 1.

The first control stage 17 is illustrated in FIG. 3, and also the driving stage 8 and the corresponding transformer 3, further to the battery 2 are shown; the second control stage 18 is identical to the first control stage 17.

In detail, the first control stage 17 comprises a resistive input line 28, a resistive damping element 30, a current limiter 31, a voltage limiter or low-voltage clamp circuit 32, a protection circuit 34, and a protection transistor 35.

The resistive input line 28 is connected between the activation input 17*a* and the gate terminal 11*b* of the power transistor 11, for transferring the first activation signal T1 supplied by the logic unit 6 (here not illustrated).

Figure 4:
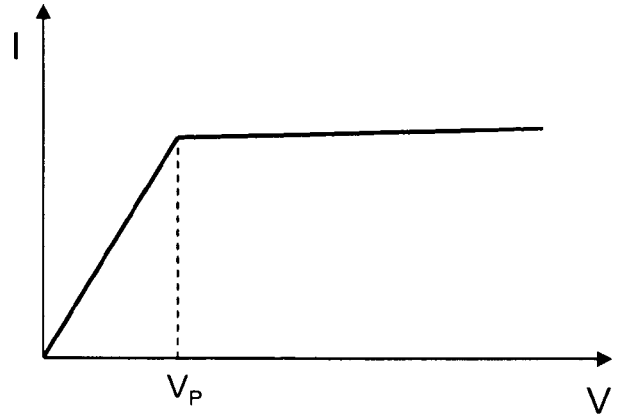
FIG. 4 is a graph representing the voltage-current characteristic of a component illustrated in FIG. 3.

The resistive damping element 30 and the current limiter 31 are connected in parallel between the gate and collector terminals 11*b*, 11*a* of the power transistor 11. In addition, the resistive damping element 30 is non-linear and, preferably, of a JFET type. In particular, the resistive damping element 30 has the current-voltage characteristic that is illustrated in FIG. 4: the resistance, which is the reciprocal of the slope of the characteristic is substantially constant as long as the voltage applied is lower than a pinch-off voltage $V_P$ and becomes substantially infinite when the pinch-off voltage $V_P$ is exceeded. In practice, then, when the voltage between the collector and gate terminals 11*a*, 11*b* of the power transistor 11 exceeds the pinch-off voltage $V_P$, the resistive damping element 30 is an open circuit.

Figure 5A:
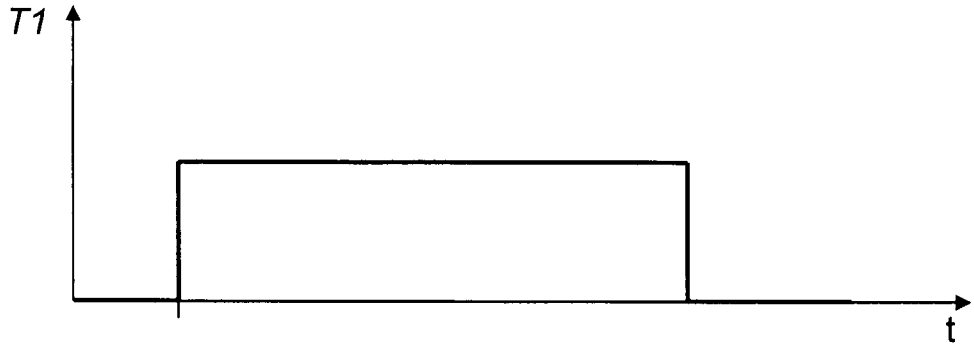
FIGS. 5A–5C are plots of quantities present in the apparatus of FIG. 1, in a first operating condition.
Figure 5B:
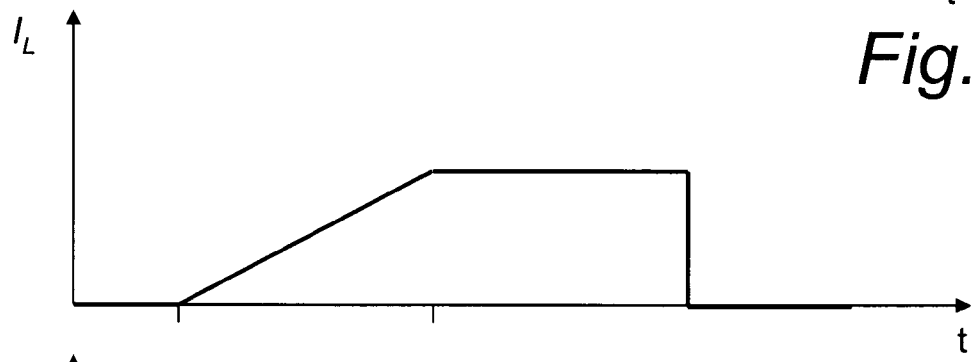
Figure 5C:
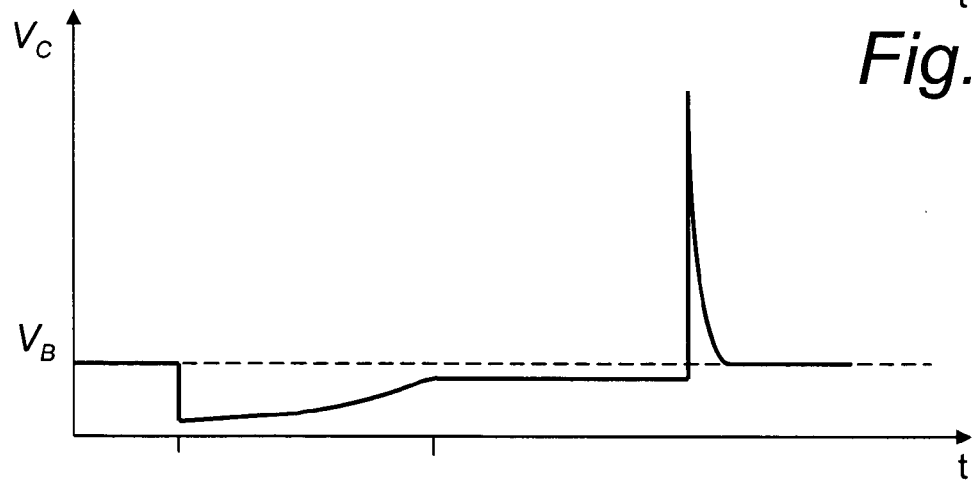
Figure 6A:
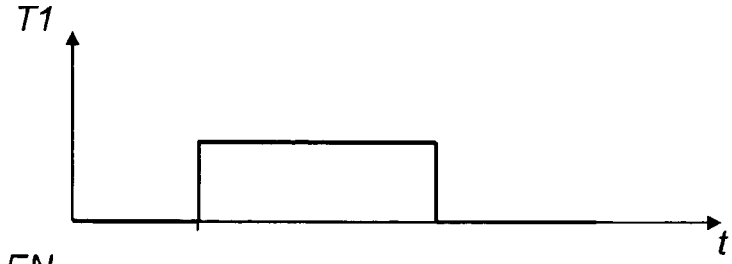
FIGS. 6A–6D are plots of quantities present in the apparatus of FIG. 1, in a second operating condition.
Figure 6B:
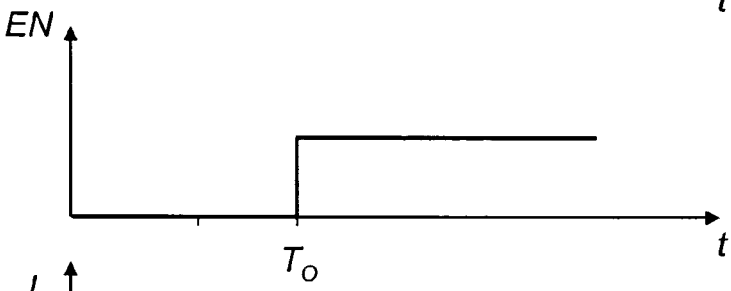
Figure 6C:
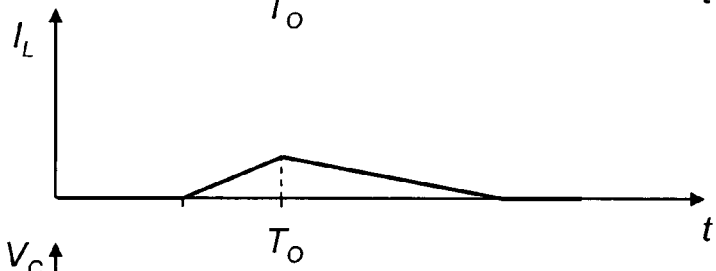
Figure 6D:
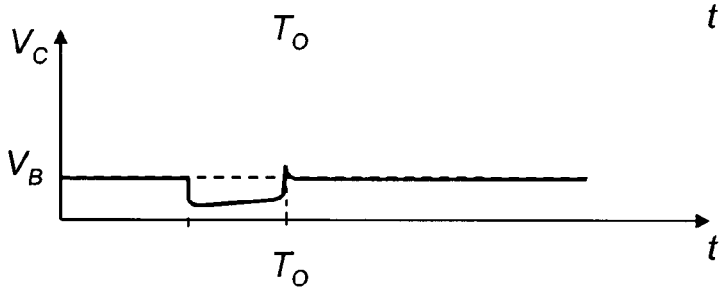

The current limiter 31 controls the power transistor 11 during the step of energizing the transformer 3. More precisely, when the winding current $I_L$ flowing in the primary winding 3*a* of the transformer 3 reaches a predetermined value, the current limiter 31 intervenes so as to maintain the value of the winding current $I_L$ constant. In this stage, moreover, the resistive damping element 30 prevents possible overshoots of the collector voltage VC, which would otherwise be amplified in the secondary winding 3*b* on account of the ratio of transformation of the transformer 3, so creating the undesirable risk of sparks. By way of example, the plots of the first activation signal T1 of the winding current $I_L$ and of the collector voltage are illustrated in FIGS. 5A–5C.

With reference once again to FIG. 3, the voltage limiter or low-voltage clamp circuit 32 has a non-inverting input 32*a* and an inverting input 32*b*, which form the first sensing input and, respectively, the second sensing input of the control stage 17 and are thus connected, respectively, to the collector terminal 11*a* of the power transistor 11 (through the decoupling diode 22) and to the battery 2. In addition, an enabling input 32*c* of the low-voltage clamp circuit 32 is connected to an enabling output of the protection circuit 34 by means of an inverter 37; and a limitation output 32*d* of the low-voltage clamp circuit 32 is connected to the gate terminal 11*b* of the power transistor 11. The enabling output of the protection circuit 34, which supplies an enabling signal EN, is connected to a base terminal of the protection transistor 35, which, in addition, has an emitter terminal connected to the ground line 15 and a collector terminal connected to an intermediate node 28*a* of the resistive input line 28.

The protection circuit 34, which is in itself known and is not illustrated in detail, detects malfunctioning states of the apparatus 1 and accordingly enables the low-voltage clamp circuit 32 and the protection transistor 35 by sending the enabling signal EN to a predetermined logic value (in this case high, for example 5 V); clearly, the low-voltage clamp circuit 32 receives the negated enabling signal $\overline{EN}$, which has a second logic value (low, 0 V). In particular, the protection circuit enables the low-voltage clamp circuit 32 and the protection transistor 35 at least when:

- the action of the resistive damping element 30 is not sufficient for limiting the oscillation of the collector voltage $V_C$ (for example, on account of the tolerances of fabrication of the resistive damping element 30 or of drifts of the power transistor 11, due normally to the variations in temperature and to wear);
- the energizing of one of the transformers 3 does not follow a behavior envisaged (for example, the winding current $I_L$ increases too slowly on account of dispersion); and
- the generation of a spark fails.

When it is activated, the protection transistor 35 is saturated and hence its collector terminal, which is connected to the intermediate node 28*a* of the resistive input line 28, is at a saturation voltage, just a little higher than 0 V and such as to switch off the power transistor 11. The low-voltage clamp circuit 32 acts, instead, so as to counter the variations of voltage between its non-inverting input 32*a* and inverting input 32*b*. In greater detail, the low-voltage clamp circuit 32 supplies a control current $I_C$ which, flowing through a section of the resistive input line 28 and the protection transistor 35, increases the voltage on the gate terminal 11*b* of the power transistor 11, which tends to conduct. In this way, the winding current $I_L$ is reduced progressively, preventing overshoots of the collector voltage $V_C$. By way of example, FIGS. 6*a*–6*d* show the waveforms, respectively, of the first activation signal T1, of the enabling signal EN, of the winding current $I_L$, and of the collector voltage $V_C$ in the case of a malfunctioning detected at an instant $T_0$.

Figure 7:
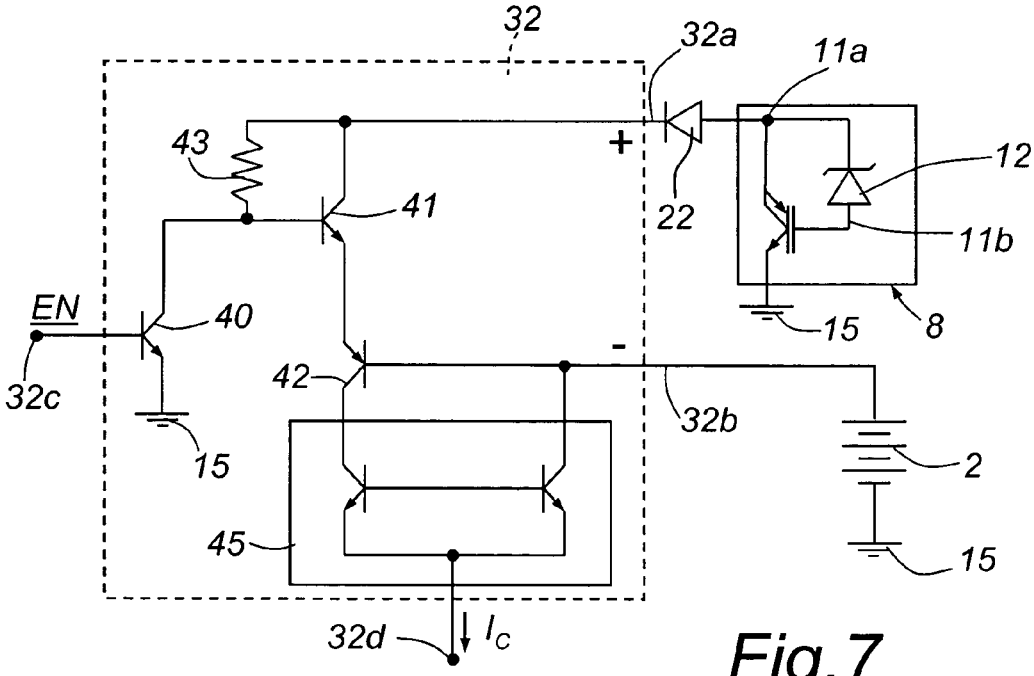
FIG. 7 is a detailed circuit diagram corresponding to a circuit illustrated in FIG. 3.

According to the described embodiment of the invention, the low-voltage clamp circuit 32 has the structure illustrated in FIG. 7, where, for reasons of clarity, also the battery 2 and the power transistor 11 are shown. In detail, the low-voltage clamp circuit comprises an enabling transistor 40, a first limitation transistor 41 and a second limitation transistor 42, a resistor 43, and a current amplifier 45. The base terminal of the enabling transistor 40 forms the enabling input 32*c* of the low-voltage clamp circuit 32 and receives the negated enabling signal EN. The emitter and collector terminals of the enabling transistor 40 are connected to the ground line 15 and, respectively, to the base terminal of the first limitation transistor 41.

The first limitation transistor 41, of an NPN type, and the resistor 43 are integrated power devices, preferably of the vertical-current-flow type; in the embodiment illustrated, the resistor 43 is of the JFET type. The collector terminal of the first limitation transistor 41 moreover forms the non-inverting input 32*a* of the low-voltage clamp circuit 32, while the emitter terminal is connected to the emitter terminal of the second limitation transistor 42.

The second limitation transistor 42, which is a standard bipolar transistor of PNP type, has a collector terminal and a base terminal connected to a first and, respectively, to a second input of the current amplifier 45; in addition, the base terminal of the second limitation transistor 42 forms the inverting input 32*b* of the low-voltage clamp circuit 32.

The current amplifier 45 is an known amplifier, preferably based upon a current-mirror circuit; its output forms the limitation output 32*d* of the low-voltage clamp circuit 32 and supplies the control current $I_C$.

When the protection circuit 34 of FIG. 3 detects any malfunctioning, the negated enabling signal EN is low and the enabling transistor 40 is inhibited. Consequently, a base current $I_B$ can flow through the resistor 43 to the base terminal of the first limitation transistor 41, which is on. The current flowing through the collector terminal and emitter terminal of the first limitation transistor 41 also flow through the second limitation transistor 42 and is amplified by the current amplifier 45, which supplies the control current $I_C$ for driving the power transistor 11. In the above-described operating conditions, between the non-inverting input 32*a* and inverting input 32*b* of the low-voltage clamp circuit 32 there is a differential voltage $V_D$ given by:

$$V_D = V_{RHv} + V_{BE1} + V_{BE2}$$

where $V_{RHv}$ is the voltage across the resistor 43, and $V_{BE1}$, $V_{BE2}$ are the base-emitter voltages of the first limitation transistor 41 and, respectively, of the second limitation transistor 42. The low-voltage clamp circuit 32 opposes the variations of the differential voltage $V_D$ and thus of the collector voltage $V_C$. In fact, as the collector voltage $V_C$ and the differential voltage $V_D$ increase, the current flowing in the limitation transistors 41, 42 increases, also causing the control current $I_C$ to increase; consequently, the power transistor 11 is biased to be more conductive and hence tends to counter the rise in the collector voltage $V_C$.

In addition to the above-mentioned advantages regarding to the reduction in the overall dimensions and the need to use just one pin of the logic unit 6, the multichannel ignition control device according to the invention enables implementation of various control functions for which direct connection to the high-voltage terminals of the power transistors is necessary. In particular, it is possible to dampen the overshoots of the collector voltage of the power transistors, which may cause undesirable sparks both during normal operation, and in the event of failure. It is therefore evident that the safety of the apparatus 1, which incorporates the multichannel ignition control device according to the invention, is significantly improved.

Finally, it is evident that modifications and variations may be made to the device described herein, without thereby departing from the scope of the present invention.

In the first place, the invention could be used also in fields other than that of internal-combustion engines, as has already been mentioned. In addition, it is clear that the device according to the invention can be used for driving more than two transformers; namely, for each transformer present a respective control stage and a respective driving stage, provided with a power transistor, are used. Also in this case, a single discharge-sensing circuit would, however, be used, which co-operates with the collector terminals of all of the power transistors so as to occupy a single pin of the logic unit.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. An inductive load control device, comprising:

a high voltage power transistor including a first conduction terminal to drive an inductive load, the power transistor further including a control terminal;

a control stage having a control input receiving an activation signal and an output connected to the control terminal of the power transistor to control selective driving of the inductive load wherein the control stage includes a current limiting circuit connected between the first conduction terminal and control terminal of the high voltage power transistor; and a sensor circuit connected to the first conduction terminal of the high voltage power transistor and operable to detect successful driving of the inductive load.

2. An inductive load control device, comprising:

a high voltage power transistor including a first conduction terminal to drive an inductive load, the power transistor further including a control terminal;

a control stage having a control input receiving an activation signal and an output connected to the control terminal of the power transistor to control selective driving of the inductive load;

a sensor circuit connected to the first conduction terminal of the high voltage power transistor and operable to detect successful driving of the inductive load; and a logic circuit connected to the control input of the control stage to selectively control actuation of the connected driving stage and receive a detection signal from the sensor circuit indicative of detected successful driving of the inductive load.

3. An inductive load control device, comprising:

a high voltage power transistor including a first conduction terminal to drive an inductive load, the power transistor further including a control terminal;

a control stage having a control input receiving an activation signal and an output connected to the control terminal of the power transistor to control selective driving of the inductive load; and a sensor circuit connected to the first conduction terminal of the high voltage power transistor and operable to detect successful driving of the inductive load wherein the sensor circuit comprises a voltage comparison device that compares a voltage on the first conduction terminal of the high voltage power transistor to a threshold and generates a detection signal when the voltage exceeds the threshold.

4. A multichannel electronic-ignition control device, comprising:

a plurality of driving stages, one for each channel, and each having a high-voltage terminal to drive an inductive load; and a control circuit, connected to each of the driving stages, including a corresponding plurality of control stages that are integrated in a single semiconductor body and each connected to the high-voltage terminal of a respective one of the driving stages, wherein each driving stage comprises a power transistor having a control terminal and further having a conduction terminal forming the high-voltage terminal, and wherein each control stage comprises a resistive damping element connected between the control and conduction terminals of the power transistors.

5. The device according to claim 4, wherein the resistive damping element is non-linear.

6. A multichannel electronic-ignition control device, comprising:

a plurality of driving stages, one for each channel, and each having a high-voltage terminal to drive an inductive load; and a control circuit, connected to each of the driving stages, including a corresponding plurality of control stages that are integrated in a single semiconductor body and each connected to the high-voltage terminal of a respective one of the driving stages, wherein each control stage comprises a low-voltage clamp circuit connected to its corresponding driving stage for limiting the operating voltage in predetermined operating conditions.

7. The device according to claim 6, wherein the low-voltage clamp circuit is selectively activatable in the predetermined operating conditions.

8. An apparatus for electronic ignition comprising:

a battery supplying a supply voltage;

a plurality of transformers, each having primary and secondary windings connected to the battery;

an ignition-control circuit also connected to the battery and having:

a plurality of driving stages, one for each transformer, each driving stage having an output coupled to the primary winding of the corresponding transformer, a corresponding plurality of control stages, one for each driving stage, which are integrated on a single semiconductor body, a logic control unit to selectively and sequentially actuate each control stage, and thus its associated driving stage, to drive the connected primary winding of the corresponding transformed, and a detection circuit to detect driving of any of the connected primary windings and output a recognition pulse in response thereto, and wherein the recognition pulses are sensed by the logic control circuit.

9. The apparatus according to claim 8, wherein each driving stage includes a high voltage terminal connected to the primary winding of the corresponding transformer.

10. An inductive load control device, comprising:

a high voltage power transistor including a first conduction terminal to drive an inductive load, the power transistor further including a control terminal;

a control stage having a control input receiving an activation signal and an output connected to the control terminal of the power transistor to control selective driving of the inductive load wherein the control stage includes a non-linear resistor connected between the first conduction terminal and control terminal of the high voltage power transistor; and a sensor circuit connected to the first conduction terminal of the high voltage power transistor and operable to detect successful driving of the inductive load.

11. The device of claim 10 further including a diode connected between the first conduction terminal of the high voltage power transistor and the sensor circuit.

12. The device of claim 10 wherein the inductive load is a primary coil of a voltage step up transformer.

13. A multichannel electronic-ignition control device, comprising:

a plurality of driving stages, one for each channel, and each having a high-voltage terminal to drive an inductive load; and a control circuit, connected to each of the driving stages, including a corresponding plurality of control stages that are integrated in a single semiconductor body and each connected to the high-voltage terminal of a respective one of the driving stages;

wherein the control circuit comprises a discharge-sensing circuit, having a plurality of inputs each connected to corresponding high-voltage terminals of the driving stages, and an output generating a recognition pulse whenever an operating voltage on one of the high-voltage terminals exceeds a predetermined threshold voltage.

14. The device according to claim 13, wherein the control stages are high-voltage stages.

15. The device according to claim 13, wherein the discharge-sensing circuit comprises a comparator having at least one first input connected to said high-voltage terminals and a second input connected to the threshold voltage.

16. The device according to claim 13, further including a logic circuit to selectively and sequentially actuate each control stage, and thus its associated driving stage, to drive the connected inductive load wherein the recognition pulses are received by the logic circuit.

17. The device according to claim 13, wherein each driving stage comprises a power transistor having a control terminal and further having a conduction terminal forming the high-voltage terminal.

18. The device according to claim 13 wherein the control circuit comprises a decoupling circuit that decouples the high-voltage terminals of the driving stages from one another.

19. The device according to claim 18, wherein the decoupling circuit comprises a plurality of diodes, each having an anode terminal connected to the high-voltage terminal of a respective driving stage and a cathode terminal connected to a substrate of said semiconductor body.

20. A multichannel inductive load control device, comprising:

a plurality of driving stages, one for each of a plurality of inductive load channels, and each having a high-voltage terminal to drive its associated inductive load;

a control circuit, including:

a plurality of control stages, one for each driving stage, each control stage including a control terminal and an actuation terminal, the actuation terminal connected to cause actuation of the associated driving stage to drive the inductive load; and a sensor circuit connected to each inductive load and operable to detect successful driving of any one of the inductive loads and output a detection signal indicative thereof; and a logic circuit connected to the control terminals of the control stages to individually control actuation of the associated driving stage and receive the detection signal from the sensor circuit in response to detected successful driving of the inductive loads.

21. The device of claim 20 wherein the sensor circuit comprises a voltage comparison device that compares a voltage on any of the high voltage terminals to a threshold, the detection signal being generated when the voltage exceeds the threshold.

22. The device of claim 20 wherein the plurality of control circuits are fabricated on a single integrated circuit.

23. The device of claim 22 further including a decoupling circuit to decouple the plurality of control circuits from each other.

* * * * *